US010072600B1

(12) United States Patent
Ulrey et al.

(10) Patent No.: US 10,072,600 B1
(45) Date of Patent: Sep. 11, 2018

(54) METHOD AND SYSTEM FOR PORT FUEL INJECTION

(71) Applicant: Ford Global Technologies, LLC, Dearborn, MI (US)

(72) Inventors: Joseph Norman Ulrey, Dearborn, MI (US); Ross Dykstra Pursifull, Dearborn, MI (US); Michael James Uhrich, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 13 days.

(21) Appl. No.: 15/453,749

(22) Filed: Mar. 8, 2017

(51) Int. Cl.
*F02D 41/30* (2006.01)

(52) U.S. Cl.
CPC ..... *F02D 41/3094* (2013.01); *F02D 41/3082* (2013.01); *F02D 2200/0602* (2013.01); *F02D 2200/1002* (2013.01)

(58) Field of Classification Search
CPC .. F02D 41/30; F02D 41/3082; F02D 41/3094; F02D 2200/602; F02D 2200/1002
See application file for complete search history.

(56) References Cited

U.S. PATENT DOCUMENTS 5,884,610 A 3/1999 Reddy
7,272,485 B2 9/2007 Amano et al.
7,463,967 B2 12/2008 Ancimer et al.
8,768,599 B2 7/2014 Blanchard et al.
9,303,583 B2 * 4/2016 Surnilla ..... F02D 41/3094
9,334,824 B2 * 5/2016 Pursifull ..... F02D 41/008
2016/0153383 A1 6/2016 Ulrey et al.
2016/0153384 A1 6/2016 Ulrey et al.

FOREIGN PATENT DOCUMENTS

WO 9931380 A1 6/1999

OTHER PUBLICATIONS

Trzeciak, Justin, et al., "Systems and Methods for Operating a Lift Pump," U.S. Appl. No. 15/353,432, filed Nov. 16, 2016, 82 pages.

* cited by examiner

*Primary Examiner* — Hieu T Vo
(74) *Attorney, Agent, or Firm* — Julia Voutyras; McCoy Russell LLP

(57) ABSTRACT

Methods and systems are provided for controlling fuel injection via a port fuel injector. At low load conditions, a lift pump coupled to a port injector may be deactivated, allowing fuel rail pressure to drop to fuel vapor pressure. Fuel may be delivered to engine cylinders while fuel rail pressure remains at fuel vapor pressure, with the lift pump still deactivated, for a duration until the accumulated amount of fuel delivered via port injection exceeds a threshold. Thereafter, the lift pump may be reactivated, allowing the fuel pump to be maintained disabled for longer periods of time, and providing fuel economy benefits.

20 Claims, 4 Drawing Sheets

METHOD AND SYSTEM FOR PORT FUEL INJECTION

FIELD

The present description relates generally to methods and systems for controlling fuel injection via a port fuel injector.

BACKGROUND/SUMMARY

Engines may be configured with various fuel injection systems for delivering a desired amount of fuel to an engine for combustion. One type of fuel injection system includes a port fuel injector which delivers fuel into an intake port of an engine cylinder. Fuel is delivered to the port fuel injector via a port injection fuel rail that is pressurized via a lift pump. Another type of fuel injection system includes a direct fuel injector which delivers fuel directly into an engine cylinder at a higher pressure than the port injector. Fuel is drawn from a fuel tank via the lift pump and then delivered to the direct fuel injector via a direct injection fuel rail that is pressurized via a high pressure pump.

Port and direct fuel injectors are configured to have a dynamic range of fuel injection capabilities. As a result, a single port fuel injector may provide a high fuel injection quantity for maximum cylinder air charge during high engine torque demand conditions as well a small fuel injection quantity for minimum cylinder air charge during low engine torque demand conditions. However, as the fuel injection quantity decreases, the ability of a fuel injector to accurately deliver the desired volume decreases. Specifically, the fuel quantity injected as a "percent of value" may have reduced accuracy as the fuel quantity or pulse width decreases. Fuel air ratio error is proportional to "percent of value" error. Thus, fuel injection errors can result in air-fuel ratio discrepancies in cylinders, leading to misfires, reduced fuel economy, increased tailpipe emissions, and an overall decrease in engine efficiency.

One example approach for increasing the accuracy of delivering small volumes of fuel is shown by Ulrey et al in US20160153383. Therein, a lift pump is intermittently operated to maintain the pressure at an inlet of the higher pressure fuel pump, and at the fuel rails, above fuel vapor pressure. In particular, the lift pump is maintained disabled until a peak outlet pressure of the fuel pump decreases from a peak outlet pressure corresponding to a previous fuel injection pulse. The duration is learned as a minimum pulse duration, and during subsequent low load conditions, a fuel injection pulse having the minimum pulse duration is applied to the fuel pump. However, operating a fuel injector at minimum pulse width may increase fuel consumption due to increased air charge delivery. In addition, fuel vapor purge may be limited due to low fuel injection quantity since vapor purge is typically limited to a function (e.g., 40%) of the entire fuel mass needed for combustion. Enabling the fuel vapor purge to meet emissions standards (for example, to remove approximately 80% of the vapor from the canister with a defined duration of a drive cycle) with the limited vapor purge rate may lead to the need for expensive fuel vapor purge design alternatives (such as a bigger canister or multiple canisters). As such, this may unnecessarily increase component costs. The inventors herein have recognized that port fuel injection may be more fuel vapor tolerant than expected. As a result, port fuel injection accuracy may increase when operated at or around (e.g., slightly above fuel vapor pressure, such as 30 kPa above fuel vapor pressure) because the vapor pressure is substantially constant and free of fuel injection-caused pressure pulsations. Therefore the issues described above may be at least partly addressed by a method for an engine comprising: in response to a drop in engine load, deactivating a lift pump; and port injecting fuel while fuel rail pressure remains at or around fuel vapor pressure, with the lift pump deactivated. In this way, low fuel mass port injection accuracy can be improved while extending a duration that a lift pump is disabled.

As one example, in response to a drop in engine load (e.g. when torque demand is low), the lift pump may be deactivated and the lift pump deactivation may be maintained while the fuel rail pressure decreases from a first rail pressure all the way to (or near to) a fuel vapor pressure. Port fuel injection to combusting cylinders of the engine may be continued while the fuel rail pressure decreases from the first rail pressure all the way to (or near to) the fuel vapor pressure. Port injection may be further continued while fuel rail pressure remains at fuel vapor pressure, with the lift pump deactivated, for a duration. Over the duration, an amount of fuel injected by the injectors may be accumulated. Once the accumulated fuel amount reaches a threshold (e.g., 10% of the fuel rail volume), the lift pump may be reactivated to re-pressurize the fuel rail. Thereafter port injection may be continued with the lift pump on. This mode may be precluded if the vehicle is significantly off level (e.g., at greater than 3° tilt) as measured by the vehicle's inertial reference (or a tilt sensor). This reduces the necessity of testing this mode in off-angle positioning.

In this way, the on-duration of a fuel lift pump may be reduced. As a result, energy consumption of a fuel pump may be minimized without causing fuel vapor ingestion issues at the fuel rail. By reducing fuel rail pressure to a vapor pressure that that is at or around fuel vapor pressure (e.g., 30 kPa above fuel vapor pressure) for a limited duration of time, while a lift pump is disabled, a small quantity of liquid fuel instead of a combination of liquid fuel and vaporous fuel may be accurately injected into the engine cylinders up to a threshold volume without ingesting fuel vapor. In addition, the injector-to-injector variability and shot-to-shot variability of a given injector may be reduced, which allows for cost reduction in the fuel vapor handling system. Further, the need to operate port fuel injectors at minimum pulse width is obviated. This reduces the amount of air charge delivered to engine cylinders at low loads, leading to lower fuel consumption, and fewer cylinder-to-cylinder air/fuel ratio and torque deviations. Furthermore, fuel vapor purging is not limited, increasing canister purging efficiency over a given drive cycle.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
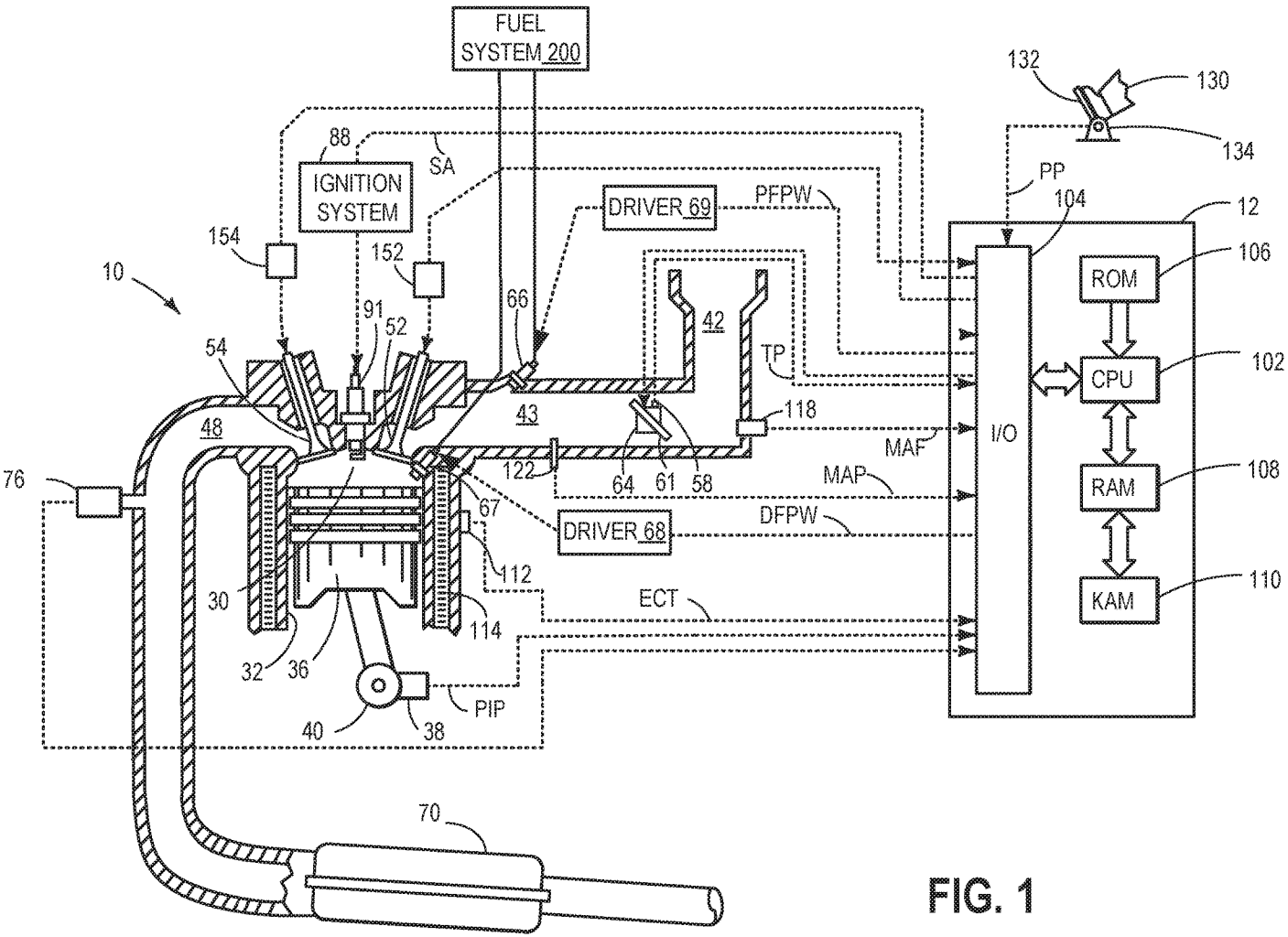
FIG. 1 shows a schematic depiction of an engine system.
Figure 2:
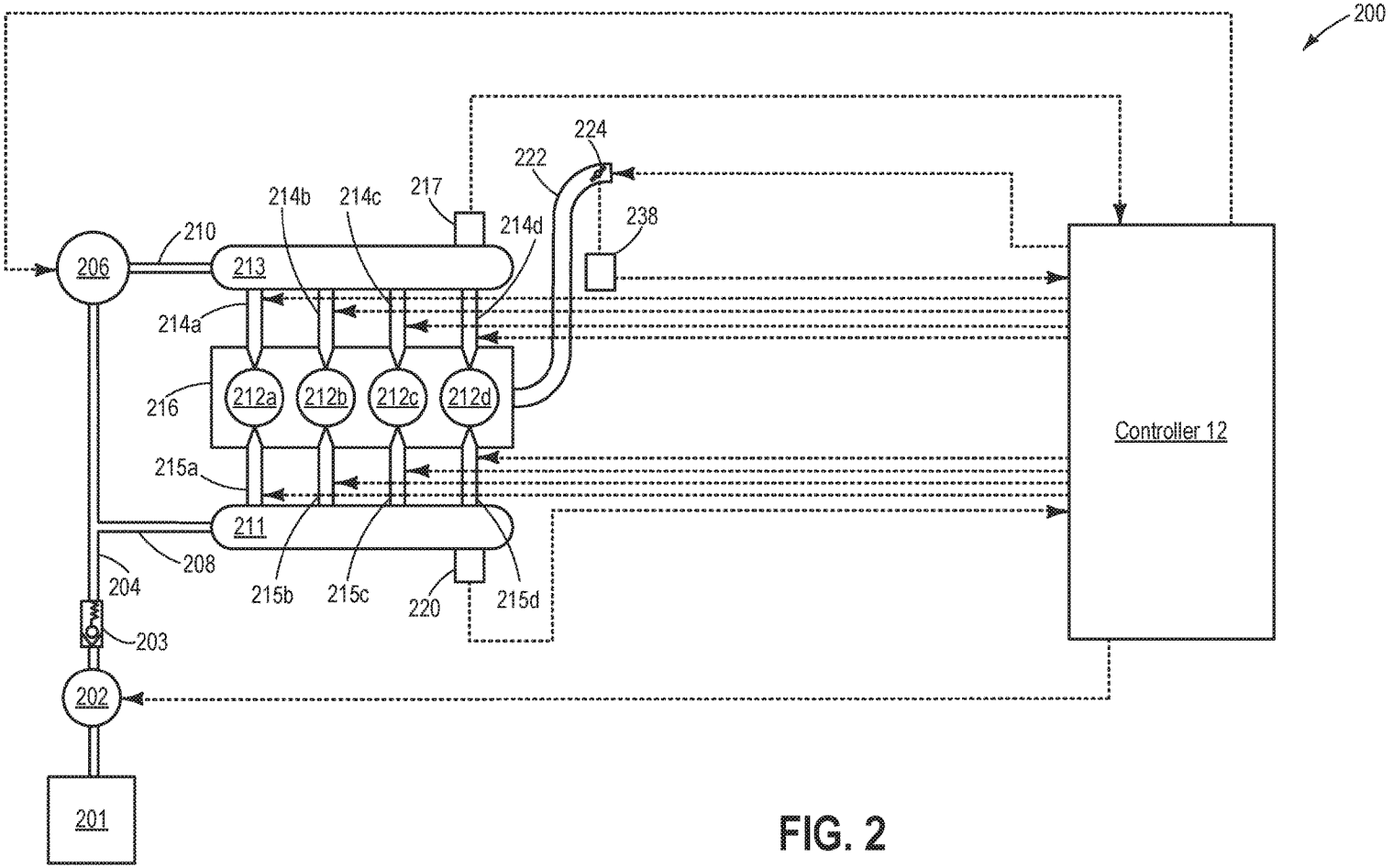
FIG. 2 shows a schematic diagram of a dual injector, single fuel system coupled to the engine system of FIG. 1.

The following description relates to systems and methods for accurately port injecting a small quantity of fuel in an engine, such as the engine system of FIG. 1, using a dual injector, single fuel system, such as the fuel system of FIG. 2. A controller may be configured to perform a control routine, such as the example routine of FIG. 3, to accurately port inject limited quantities of fuel into a cylinder in response to a drop in engine load without incurring fuel vapor ingestion issues. A prophetic fuel injection example wherein fuel is delivered via a port injector at fuel vapor pressure conditions is illustrated at FIG. 4. In this way, fuel injection accuracy at low loads is improved.

FIG. 1 shows a schematic depiction of a spark ignition internal combustion engine 10 with a dual injector system, where engine 10 is configured with both direct and port fuel injection. Engine 10 comprises a plurality of cylinders of which one cylinder 30 (also known as combustion chamber 30) is shown in FIG. 1. Cylinder 30 of engine 10 is shown including combustion chamber walls 32 with piston 36 positioned therein and connected to crankshaft 40. A starter motor (not shown) may be coupled to crankshaft 40 via a flywheel (not shown), or alternatively, direct engine starting may be used.

Combustion chamber 30 is shown communicating with intake manifold 43 and exhaust manifold 48 via intake valve 52 and exhaust valve 54, respectively. In addition, intake manifold 43 is shown with throttle 64 which adjusts a position of throttle plate 61 to control airflow from intake passage 42.

Intake valve 52 may be operated by controller 12 via actuator 152. Similarly, exhaust valve 54 may be activated by controller 12 via actuator 154. During some conditions, controller 12 may vary the signals provided to actuators 152 and 154 to control the opening and closing of the respective intake and exhaust valves. The position of intake valve 52 and exhaust valve 54 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 30 may alternatively include an intake valve controlled via electric valve actuation and an exhaust valve controlled via cam actuation including CPS and/or VCT. In other embodiments, the intake and exhaust valves may be controlled by a common valve actuator or actuation system, or a variable valve timing actuator or actuation system.

In another embodiment, four valves per cylinder may be used. In still another example, two intake valves and one exhaust valve per cylinder may be used.

Combustion chamber 30 can have a compression ratio, which is the ratio of volumes when piston 36 is at bottom center to top center. In one example, the compression ratio may be approximately 9:1. However, in some examples where different fuels are used, the compression ratio may be increased. For example, it may be between 10:1 and 11:1 or 11:1 and 12:1, or greater.

In some embodiments, each cylinder of engine 10 may be configured with one or more fuel injectors for providing fuel thereto. As shown in FIG. 1, cylinder 30 includes two fuel injectors, 66 and 67. Fuel injector 67 is shown directly coupled to combustion chamber 30 for delivering injected fuel directly therein in proportion to the pulse width of signal DFPW received from controller 12 via electronic driver 68. In this manner, direct fuel injector 67 provides what is known as direct injection (hereafter referred to as "DI") of fuel into combustion chamber 30. While FIG. 1 shows injector 67 as a side injector, it may also be located overhead of the piston, such as near the position of spark plug 91. Such a position may improve mixing and combustion due to the lower volatility of some alcohol based fuels. Alternatively, the injector may be located overhead and near the intake valve to improve mixing.

Fuel injector 66 is shown arranged in intake manifold 43 in a configuration that provides what is known as port injection of fuel (hereafter referred to as "PFI") into the intake port upstream of cylinder 30 rather than directly into cylinder 30. Port fuel injector 66 delivers injected fuel in proportion to the pulse width of signal PFPW received from controller 12 via electronic driver 69.

Fuel may be delivered to fuel injectors 66 and 67 by a high pressure fuel system 200 including a fuel tank, fuel pumps, and fuel rails (elaborated at FIG. 2). Further, as shown in FIG. 2, the fuel tank and rails may each have a pressure transducer providing a signal to controller 12.

Exhaust gases flow through exhaust manifold 48 into emission control device 70 which can include multiple catalyst bricks, in one example. In another example, multiple emission control devices, each with multiple bricks, can be used. Emission control device 70 can be a three-way type catalyst in one example.

Exhaust gas sensor 76 is shown coupled to exhaust manifold 48 upstream of emission control device 70 (where sensor 76 can correspond to a variety of different sensors). For example, sensor 76 may be any of many known sensors for providing an indication of exhaust gas air/fuel ratio such as a linear oxygen sensor, a UEGO, a two-state oxygen sensor, an EGO, a HEGO, or an HC or CO sensor. In this particular example, sensor 76 is a two-state oxygen sensor that provides signal EGO to controller 12 which converts signal EGO into two-state signal EGOS. A high voltage state of signal EGOS indicates exhaust gases are rich of stoichiometry and a low voltage state of signal EGOS indicates exhaust gases are lean of stoichiometry. Signal EGOS may be used to advantage during feedback air/fuel control to maintain average air/fuel at stoichiometry during a stoichiometric homogeneous mode of operation. A single exhaust gas sensor may serve 1, 2, 3, 4, 5, or other number of cylinders.

Distributorless ignition system 88 provides ignition spark to combustion chamber 30 via spark plug 91 in response to spark advance signal SA from controller 12.

Controller 12 may cause combustion chamber 30 to operate in a variety of combustion modes, including a homogeneous air/fuel mode and a stratified air/fuel mode by controlling injection timing, injection amounts, spray patterns, etc. Further, combined stratified and homogenous mixtures may be formed in the chamber. In one example, stratified layers may be formed by operating injector 66 during a compression stroke. In another example, a homogenous mixture may be formed by operating one or both of injectors 66 and 67 during an intake stroke (which may be open valve injection). In yet another example, a homogenous mixture may be formed by operating one or both of injectors 66 and 67 before an intake stroke (which may be closed valve injection). In still other examples, multiple injections from one or both of injectors 66 and 67 may be used during one or more strokes (e.g., intake, compression, exhaust, etc.). Even further examples may be where different injection timings and mixture formations are used under different conditions, as described below.

Controller 12 can control the amount of fuel delivered by fuel injectors 66 and 67 so that the homogeneous, stratified, or combined homogenous/stratified air/fuel mixture in chamber 30 can be selected to be at stoichiometry, a value rich of stoichiometry, or a value lean of stoichiometry.

Controller 12 is shown in FIG. 1 as a conventional microcomputer including: central processing unit (CPU) 102, input/output (I/O) ports 104, read-only memory (ROM) 106, random access memory (RAM) 108, keep alive memory (KAM) 110, and a conventional data bus.

Controller 12 is shown receiving various signals from sensors coupled to engine 10, in addition to those signals previously discussed, including measurement of inducted mass air flow (MAF) from mass air flow sensor 118; engine coolant temperature (ECT) from temperature sensor 112 coupled to cooling sleeve 114; a profile ignition pickup signal (PIP) from Hall effect sensor 38 coupled to crankshaft 40; and throttle position TP from throttle position sensor 58 and an absolute Manifold Pressure Signal MAP from sensor 122. Engine speed signal RPM is generated by controller 12 from signal PIP in a conventional manner and manifold pressure signal MAP from a manifold pressure sensor provides an indication of vacuum, or pressure, in the intake manifold. During stoichiometric operation, this sensor can give an indication of engine load. Further, this sensor, along with engine speed, can provide an estimate of charge (including air) inducted into the cylinder. In one example, sensor 38, which is also used as an engine speed sensor, produces a predetermined number of equally spaced pulses every revolution of the crankshaft.

As described above, FIG. 1 merely shows one cylinder of a multi-cylinder engine, and that each cylinder has its own set of intake/exhaust valves, fuel injectors, spark plugs, etc. Also, in the example embodiments described herein, the engine may be coupled to a starter motor (not shown) for starting the engine. The starter motor may be powered when the driver turns a key in the ignition switch on the steering column, for example. The starter is disengaged after engine start, for example, by engine 10 reaching a predetermined speed after a predetermined time. Further, in the disclosed embodiments, an exhaust gas recirculation (EGR) system may be used to route a desired portion of exhaust gas from exhaust manifold 48 to intake manifold 43 via an EGR valve (not shown). Alternatively, a portion of combustion gases may be retained in the combustion chambers by controlling exhaust valve timing.

FIG. 2 illustrates a dual injector, single fuel system 200 with a high pressure and a low pressure fuel rail system. Fuel system 200 may be coupled to an engine, such as engine 10 of FIG. 1. Components previously introduced may be similarly numbered.

Fuel system 200 may include fuel tank 201, low pressure or lift pump 202 that supplies fuel from fuel tank 201 to high pressure fuel pump 206 via low pressure passage 204. Lift pump 202 also supplies fuel at a lower pressure to low pressure fuel rail 211 via low pressure passage 208. Thus, low pressure fuel rail 211 is coupled exclusively to lift pump 202. Fuel rail 211 supplies fuel to port injectors 215*a*, 215*b*, 215*c* and 215*d*. High pressure fuel pump 206 supplies pressurized fuel to high pressure fuel rail 213 via high pressure passage 210. Thus, high pressure fuel rail 213 is coupled to each of a high pressure pump (206) and a lift pump (202).

High pressure fuel rail 213 supplies pressurized fuel to fuel injectors 214*a*, 214*b*, 214*c*, and 214*d*. The fuel rail pressure in fuel rails 211 and 213 may be monitored by pressure sensors 220 and 217 respectively. Lift pump 202 may be, in one example, an electronic return-less pump system which may be operated intermittently in a pulse mode. The engine block 216 may be coupled to an intake pathway 222 with an intake air throttle 224.

Lift pump 202 may be equipped with a check valve 203 so that the low pressure passages 204 and 208 (or alternate compliant element) hold pressure while lift pump 202 has its input energy reduced to a point where it ceases to produce flow past the check valve 203.

Direct fuel injectors 214*a*-214*d* and port fuel injectors 215*a*-215*d* inject fuel, respectively, into engine cylinders 212*a*, 212*b*, 212*c*, and 212*d* located in an engine block 216. Each cylinder, thus, can receive fuel from two injectors where the two injectors are placed in different locations. For example, as discussed earlier in FIG. 1, one injector may be configured as a direct injector coupled so as to fuel directly into a combustion chamber while the other injector is configured as a port injector coupled to the intake manifold and delivers fuel into the intake port upstream of the intake valve. Thus, cylinder 212*a* receives fuel from port injector 215*a* and direct injector 214*a* while cylinder 212*b* receives fuel from port injector 215*b* and direct injector 214*b*.

Similar to FIG. 1, the controller 12 may receive fuel pressure signals from fuel pressure sensors 220 and 217 coupled to fuel rails 211 and 213 respectively. Fuel rails 211 and 213 may also contain one or more temperature sensors for sensing the fuel temperature within the fuel rails. Controller 12 may also control operations of intake and/or exhaust valves or throttles, engine cooling fan, spark ignition, injector, and fuel pumps 202 and 206 to control engine operating conditions. Controller 12 may further receive throttle opening angle signals indicating the intake air throttle position via a throttle position sensor 238.

Fuel pumps 202 and 206 may be controlled by controller 12 as shown in FIG. 2. Controller 12 may regulate the amount or speed of fuel to be fed into fuel rails 211 and 213 by lift pump 202 and high pressure fuel pump 206 through respective fuel pump controls (not shown). Controller 12 may also completely stop fuel supply to the fuel rails 211 and 213 by shutting down pumps 202 and 206.

Injectors 214*a*-214*d* and 215*a*-215*d* may be operatively coupled to and controlled by controller 12, as is shown in FIG. 2. An amount of fuel injected from each injector and the injection timing may be determined by controller 12 from an engine map stored in the controller 12 on the basis of engine speed and/or intake throttle angle, or engine load. Each injector may be controlled via an electromagnetic valve coupled to the injector (not shown).

Fuel may be delivered by both injectors to the cylinder during a single cycle of the cylinder. For example, each injector may deliver a portion of a total fuel injection that is combusted in cylinder 30. Further, the distribution and/or relative amount of fuel delivered from each injector may vary with operating conditions, such as engine load and engine speed. The port injected fuel may be delivered during an open intake valve event, closed intake valve event (e.g. substantially before the intake stroke), as well as during both open and closed intake valve operation. Similarly, directly injected fuel may be delivered during an intake stroke, as well as partly during previous exhaust stroke, during intake stroke, and partly during the compression stroke, for example. As such, even for a single combustion event, injected fuel may be injected at different timings from the port and direct injector. Furthermore, for a single combustion even, multiple injections of the delivered fuel may be performed per cycle. The multiple injections may be performed during the compression stroke, intake stroke, or any appropriate combination thereof.

In one example, the amount of fuel to be delivered via port and direct injectors is empirically determined and stored in a predetermined lookup tables or functions. For example, one table may correspond to determining port injection amounts and one table may correspond to determining direct injections amounts. The two tables may be indexed to engine operating conditions, such as engine speed and engine load, among other engine operating conditions. Furthermore, the tables may output an amount of fuel to inject via port fuel injection and/or direct injection to engine cylinders at each cylinder cycle.

Accordingly, depending on engine operating conditions, fuel may be injected to the engine via port and direct injectors or solely via direct injectors or solely port injectors. For example, controller 12 may determine to deliver fuel to the engine via port and direct injectors or solely via direct injectors, or solely via port injectors based on output from predetermined lookup tables as described above.

Various modifications or adjustments may be made to the above example systems. For example, the fuel passages (e.g., 204, 208, and 210) may contain one or more filters, pressure sensors, temperature sensors, and/or relief valves. The fuel passages may include one or more fuel cooling systems.

Typically, port and direct fuel injectors have a dynamic range of fuel injection capabilities. As a result, a single port fuel injector may provide a high fuel injection quantity for maximum cylinder air charge during high engine torque demand conditions as well a small fuel injection quantity for minimum cylinder air charge during low engine torque demand conditions. However, as the fuel injection quantity decreases, the ability of a fuel injector to accurately deliver the desired volume decreases. For example, when a port fuel injection quantity required to meet the torque demand drops below a minimum pulse-width of an injector, the accuracy of the port fuel injection may drop. If the port fuel injector is maintained at the minimum pulse-width, the actual fuel delivered may be more than required, resulting in more air flow and more torque delivery. If a pressure of the fuel rail pressure coupled to the port injector is lowered, via adjustments to a lift pump, there is a possibility of fuel vapor being ingested into the fuel rail instead of liquid fuel. This can result in air-fuel ratio excursions, as well as cylinder misfires.

The inventors herein have recognized that port fuel injection may be more fuel vapor tolerant than expected. Consequently, port fuel injection accuracy may increase when operated at fuel vapor pressure because the vapor pressure is constant and free of fuel injection-caused pressure pulsations. As elaborated at FIG. 3, a controller may increase low load port fuel injection accuracy by deactivating a lift pump so that a port injection fuel rail pressure can be held at fuel vapor pressure. Low fuel mass port injection may be performed by the controller with the lift pump deactivated and with the fuel rail at fuel vapor pressure. In addition to enabling accurate low mass port fuel injection, a duration over which the lift pump is disabled is extended providing electrical power saving, thus fuel economy benefits.

Figure 3:
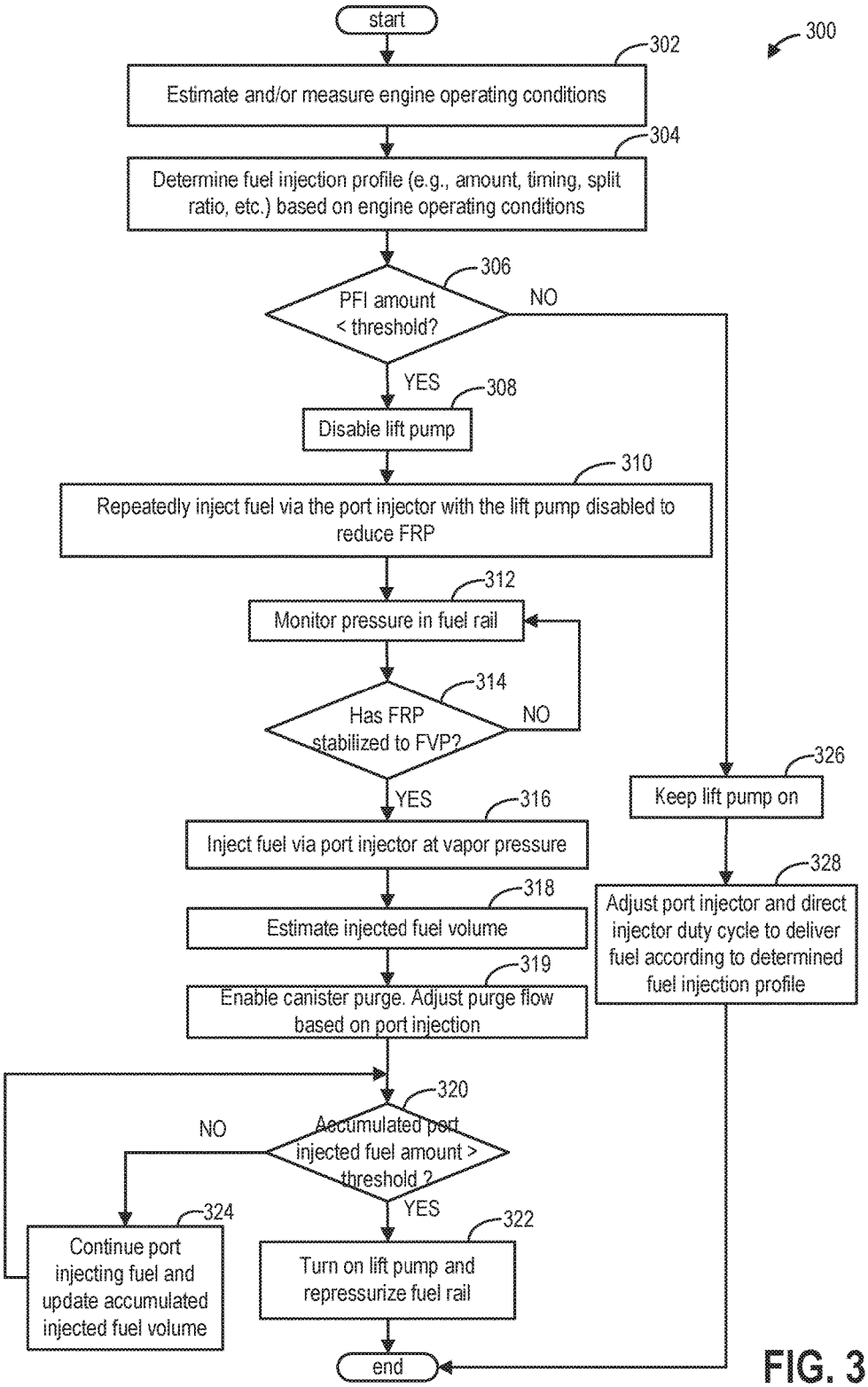
FIG. 3 is an example flowchart illustrating a high level routine for accurately port injecting small quantities of fuel into an engine cylinder with high accuracy.
Figure 4:
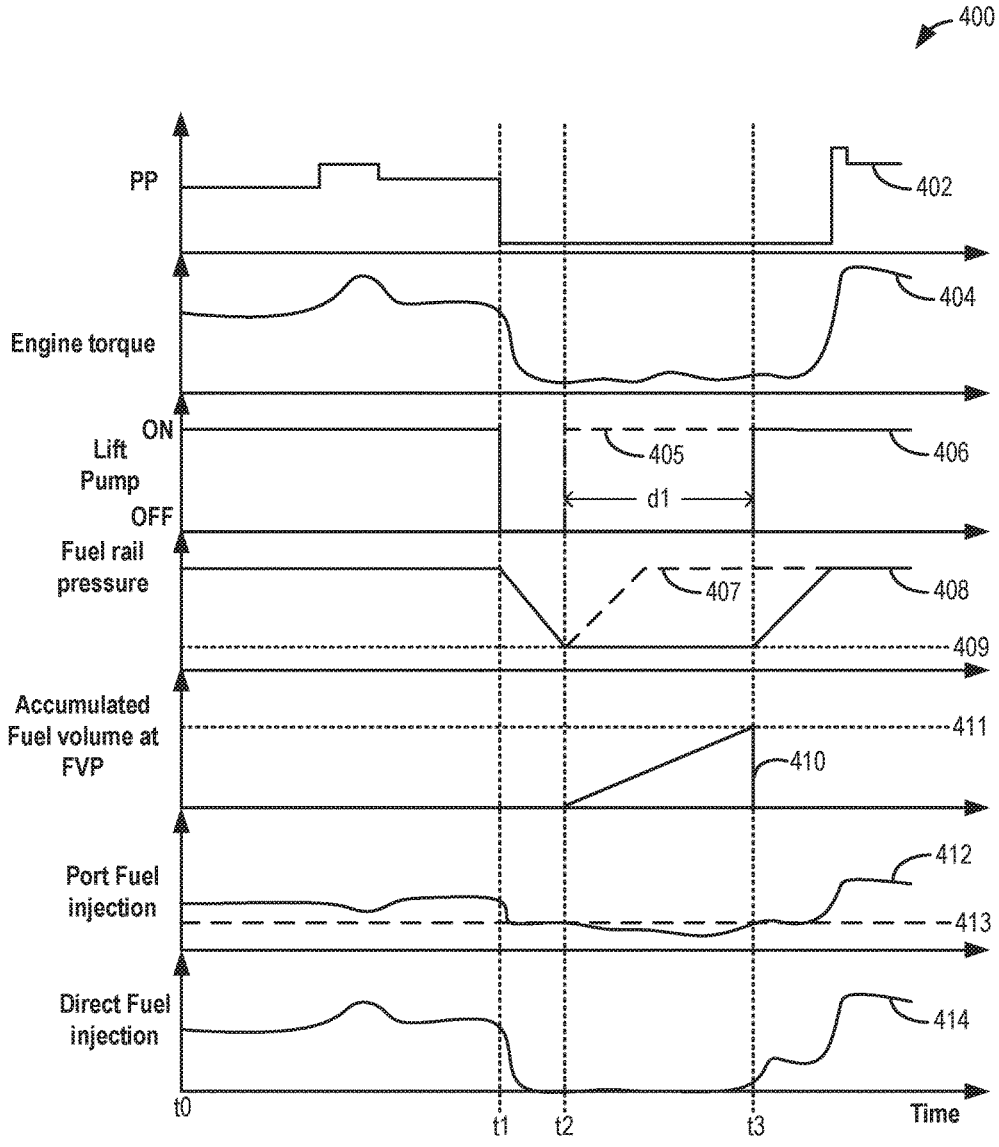
FIG. 4 shows a graph illustrating example fuel injections via a port injector at low load conditions, in accordance with the present disclosure.

Referring now to FIG. 3, an example routine 300 performed by a controller to accurately inject a small quantity of fuel via port injection during selected conditions is shown. The low port injection fuel mass may be commanded responsive to engine idling condition or when torque demand requested by the operator is low. When the fuel vapor canister effluent is predominately fuel vapor, this tends to reduce the fuel portion supplied by the fuel injectors. Instructions for carrying out method 300 and the rest of the methods included herein may be executed by a controller based on instructions stored on a memory of the controller and in conjunction with signals received from sensors of the engine system, such as the sensors described above with reference to FIGS. 1-2. The controller may employ engine actuators of the engine system to adjust engine operation, according to the methods described below.

At 302, engine operating conditions may be estimated and/or inferred. These may include, for example, engine speed, engine load, driver torque demand, ambient conditions (e.g. ambient temperature and humidity, and barometric pressure), MAP, MAF, MAT, engine temperature, boost level, etc.

Based on the estimated operating conditions, at 304, a fuel injection profile may be determined. This includes estimating a total amount (mass) of fuel to be delivered, a split ratio of fuel to be delivered via port injection relative to direct injection, fuel injection timing (e.g., in the intake stroke, in the compression stroke, open valve event, closed valve event, etc.), a number of injections over which to deliver the total amount of fuel (e.g., as a single injection or as multiple injections), etc. In one example, the total amount of fuel to be delivered into the engine may be determined from a look-up table indexed based on engine speed and load. Further, a split ratio of fuel to be delivered via port injection relative to direct injection may be determined from another look-up table also indexed based on engine speed and load. For example, at lower engine speed and load conditions, the controller may inject a larger proportion of the total fuel amount via port injection (to leverage the reduced emissions benefits of the port injection) while at higher engine speed and load conditions, the controller may inject a larger proportion of the total fuel amount via direct injection (to leverage the charge cooling benefits of the direct injection). The controller may similarly determine whether the fuel is to be delivered via direct injection only, port injection only, or each of port and direct injection.

In one example, look-up table cells may include two values, a first value representing port fuel injector fuel fractions and a second value representing direct fuel injector fuel fractions. As an example, a table value corresponding to 2000 RPM and 0.2 load may hold empirically determined values 0.4 and 0.6. The value of 0.4 or 40% may represent the port fuel injector fuel fraction, and the value 0.6 or 60% is the direct fuel injector fuel fraction. Consequently, if the desired fuel injection mass is 1 gram of fuel during an engine cycle, 0.4 grams of fuel is port injected fuel and 0.6 grams of fuel is direct injected fuel. In other examples, the table may only contain a single value at each table cell and the other value may be determined by subtracting the value in the table from a value of one. For example, if the 2000 RPM and 0.2 load table cell contains a single value of 0.6 for a direct injector fuel fraction, then the port injector fuel fraction is determined as $1-0.6=0.4$.

In one example, during low engine speed-load conditions, including engine idle conditions, fuel may be injected to the engine only via port fuel injection. Therein, the total fuel mass is delivered to a cylinder via a port injector only while a cylinder direct injector is deactivated.

In contrast, during high engine speed-load conditions, fuel may be injected to the engine only via direct injection. The total fuel mass is delivered to a cylinder via a direct injector only while a cylinder port injector is deactivated.

Further, during mid-range engine speed-load conditions, fuel may be injected to the engine via each of port and direct injection. When operating in this condition, a portion of the total fuel mass is delivered to a cylinder via a direct injector while a remaining portion of the total fuel mass is delivered to the cylinder via a port injector.

In some engine configurations, the engine may be configured with three sources of fuel: DI, PFI, and a purge injector (usually one per engine, also referred to as the canister purge valve) that injects a mixture of fuel vapor and air from the fuel vapor canister. For a given fuel amount, as the canister purge valve opening is increased, more canister fuel vapors are injected or purged into the engine, enabling the other injectors (DI and PDI) to inject less. This can cause inaccurate short duration pulse widths if the fuel rail pressure is not lowered. Therein, the look-up table cells may include an additional value corresponding to the amount of fuel receivable from canister purging, and wherein the DI and PFI fractions are adjusted to compensate for the presence of purge fuel vapors.

At 306, it may be determined whether the port fuel injection amount is less than a threshold amount. In one example, the threshold amount may correspond to an amount of fuel delivered when the port injector operates at a minimum pulse-width (at the given fuel rail pressure). For example, in response to a drop in engine load (such as during a tip-out event or when engine is at idle condition), the port fuel injection fraction determined from the look-up table may be less than the minimum pulse-width of the port injector. If the port fuel injection amount is higher than the threshold, then at 326, a lift pump may delivering fuel to a fuel rail of the port injector may be maintained activated (at an ON position). In addition, if fuel is to be delivered by direct injection, a high pressure fuel pump receiving fuel from the lift pump and delivering fuel to a fuel rail of the direct injector may also be maintained activated. At 328, port injector and direct injector duty cycles may be adjusted based on the determined fuel injection profile to deliver fuel to the engine cylinders at their respective estimated fuel fractions, as determined by the fuel split ratio lookup tables. For example, the controller may send a pulse-width signal to an actuator of the port injector to deliver a determined fraction of fuel to an engine cylinder via port injection. The controller may also send a pulse-width signal to an actuator of the direct injector to deliver a remaining fraction of fuel to an engine cylinder via direct injection. The routine then ends.

If the desired port fuel injection amount falls below the threshold amount, the method proceeds to 308 where a lift pump delivering fuel to the port injection fuel rail is deactivated. As a result, the pumping of fuel into port injection fuel rail is suspended and a fuel rail pressure in a port injection fuel rail starts to drop. As such, the lift pump also delivers fuel to a direct injection fuel rail. Specifically, a direct injector may receive fuel from a direct injection fuel rail that is pressurized by a high pressure pump, the high pressure pump receiving fuel from the lift pump.

After deactivating the lift pump, at 310, the method includes reducing the fuel rail pressure to a fuel vapor pressure (or slightly above the fuel vapor pressure, such as 30 kPa above the FVP). In one example, the fuel rail pressure may be reduced by repeatedly port injecting fuel while the lift pump is deactivated to reduce the port injection fuel rail pressure to a fuel vapor pressure. In particular, the repeated injection via the port injectors enables the fuel rail pressure to be gradually dissipated to the fuel vapor pressure.

In one example, fuel may be repeatedly injected into the cylinders solely via the port injector operating at a minimum pulse-width (and delivering a lowest-allowable volume) while the lift pump is held deactivated, and while the fuel rail pressure drops.

Additionally or optionally, the fuel rail pressure may be reduced by pumping fuel from a port injection fuel line (that is, the fuel line leading from the lift pump to the port injection fuel rail) into the high pressure fuel rail coupled to the direct injectors. Fuel may be pumped into the high pressure fuel rail up to a pressure relief point of the high pressure fuel rail. In one example, fuel may be pumped into the high pressure fuel rail by opening a valve coupling the port injection fuel line to the direct injection fuel line (that is, a fuel line leading from the lift pump to the direct injection fuel rail). If required, fuel may then be direct injected into the cylinder, such as to maintain a combustion air-fuel ratio (and provided a total fuel mass required for the given engine operating conditions).

In some examples, where direct injection is required while the port injection amount is less than the threshold, to ensure that there is sufficient pressure in the direct injection fuel rail, which supplies fuel to the direct injectors, the direct injection fuel rail pressure may be raised before deactivating the lift pump. For example, while the lift pump is deactivated, the direct injection fuel rail pressure may be raised by increasing the output of the high pressure pump. The output of the high pressure pump may be raised before the lift pump is deactivated or responsive to the deactivation of the lift pump. By sufficiently raising the pressure in the direct injection fuel rail, the direct injectors may be able to continue to supply fuel to the cylinder, even with the lift pump disabled. However, in other examples, when the PFI injection quantity is small, the DI injection may be held disabled and direct injected fuel may not be required in the cylinder.

While port fuel injection is continued with the lift pump deactivated, the amount of fuel in the fuel rail and the fuel rail pressure (FRP) decreases with each port injection event. At 312, the method includes monitoring the port injection fuel rail pressure. In particular, pressure drops within the fuel rail supplying fuel to the port injector may be monitored after each injection. For example, the controller may receive signals from the pressure sensor coupled to the fuel rail which senses the change in fuel rail pressure (FRP) after each injection. In one example, the change in fuel rail pressure at the port injection fuel rail may be sensed after a defined number of injection pulses, such as every pulse, or every couples of pulses. Alternatively, the change in fuel rail pressure may be estimated based on the size of the fuel pulse and the initial fuel rail pressure conditions, such as, by detecting the flattening of the fuel rail pressure versus injected volume curve.

At 314, it may be determined if the fuel rail pressure (FRP) of the port injection fuel rail has stabilized to a fuel vapor pressure (FVP). In one example, the controller may determine that the fuel rail pressure is at the fuel vapor pressure in response to the fuel rail pressure dropping to a value and then remaining at that value for a non-zero duration after the deactivating of the lift pump. In another example, the fuel vapor pressure for the given fuel may be determined by measuring a fuel temperature, and then calculating a fuel vapor pressure corresponding to the fuel temperature via a look-up table that accounts for the fuel's volatility. A pressure drop at the port injection fuel rail may be monitored after each injection event, and when the fuel rail pressure reaches the determined fuel vapor pressure and remains at the determined fuel vapor pressure for a non-zero duration, it may be determined that the fuel rail pressure has stabilized to the fuel vapor pressure. If the fuel rail pressure has not stabilized, the method returns to 312 wherein FRP continues to be monitored after each port fuel injection event.

At 316, after the fuel rail pressure has stabilized to the FVP, the method includes port injecting fuel while fuel rail pressure remains at fuel vapor pressure, with the lift pump deactivated. Herein fuel is injected via a port injector to provide a fuel mass corresponding to the less than threshold fuel injection amount. For example, in response to a drop in torque demand, fuel is port injected at fuel vapor pressure, with the lift pump deactivated, with a duty cycle that is less than the minimum pulse-width of injection of the port injector. The inventors herein have recognized that since the port fuel injection system has a higher tolerance when operating at FVP, port fuel injection of lower fuel masses at FVP can be sustained for a duration of time without ingesting fuel vapor and without incurring fuel injection inaccuracies. The use of the direct injection pump at fuel vapor pressure may be limited to avoid direct injection pump degradation. In other examples, fuel injector accuracy at small pulse-widths (such as pulse-widths below minimum pulse-width) may be achieved by increasing injector voltage (which reduces the variability in "fuel injector offset"). Reducing the injection pressure may necessitate longer duration fuel injection pulse-widths. At 318, a volume of fuel that has been port injected may be calculated or estimated after each injection event. In one example, the volume of fuel delivered on each port injection event may be estimated based on the (less than minimum pulse-width) duty cycle commanded and the fuel vapor pressure. In addition to estimating an amount of fuel delivered on each injection event, an accumulated or integrated amount of fuel delivered via port injection over a number of fuel injection events since the stabilization of the fuel rail pressure at FVP may be calculated. For example, the amount of fuel delivered on each port injection event since the stabilization of the fuel rail pressure at FVP may be summed.

At 319, while port injecting less than the threshold amount of fuel mass accurately at or around fuel vapor pressure, canister purging may be enabled. This enables low load canister purging that would have otherwise not been possible. For example, in engine systems where port injecting below a minimum pulse width is not enabled, fuel vapor purge may be limited due to low fuel injection quantity. In order for the canister purge to meet emissions standards, it may be desired to purge the canister (from a full load) to a threshold load within a threshold duration of a drive cycle, for example, to remove approximately 80% of the vapor from the canister within the threshold duration of the drive cycle (e.g., within a first number of emissions test cycles of the drive cycle). To achieve this, the controller may pull as much purge air through the canister and into the engine as possible over this duration. Initially, the canister is full of adsorbed fuel and the initial effluent is nearly 100% fuel vapor. As the canister load reduces, the fuel vapor concentration of the effluent drops, and becomes nearly 100% air. Engine control systems typically limit vapor purge to a fraction (e.g., 40%) of the entire fuel mass needed for combustion. As the fraction of fuel vapor becomes large, the fraction of fuel provided by the injectors is reduced. At idle conditions, when the fuel injection quantity is reduced (that is, the total fuel mass desired to be injected into the engine reduces), the injection pulse width is reduced, exacerbating the total fuel fractional error. The inventors herein have recognized that by lowering the fuel rail pressure to around the fuel vapor pressure, injector error for the port injectors for below minimum pulse-width injections is reduced, allowing the fraction of fuel vapor that can be purged to the engine to be increased. In other words, by enabling the port injector to inject fuel with fuel rail pressure at or around (for example, slightly above) fuel vapor pressure, the fraction of purge fuel vapors that can be ingested at a given load may be increased. This increases the likelihood of a more complete canister purging over a given drive cycle, eliminating the need for expensive design alternatives, such as the need for a bigger canister or multiple canisters. The technical effect is that a larger fraction of fuel vapors may be ingested with reduced air-fuel ratio disturbances and while reducing the cost of the fuel vapor purge system.

At 320, it may be determined if the accumulated port injected fuel amount is higher than a threshold amount (or threshold volume). In one example, the threshold amount corresponds to a volume of fuel that can be reliably delivered to the cylinder while the fuel rail pressure is at FVP without ingesting fuel vapor. In other words, up to that threshold amount of fuel, the fuel delivered via port injection can be reliably assumed to be liquid fuel and not gaseous fuel vapors. In one example, the threshold amount may be determined as a ratio of an integrated volume of fuel delivered via the port injector relative to a volume of the fuel rail coupled to the port injector (e.g., fuel may be port injected at FVP up to 10% of the fuel rail volume without incurring fuel vapor ingestion issues). In another example, the threshold volume is a function (e.g., fraction, such as 10%) of the port injection fuel rail volume.

As an example, for a fuel rail which can store up to 60 units of fuel, the threshold amount of fuel that can be reliably delivered as liquid fuel via port injection at FVP may be 6 units. If the port fuel injection amount is 0.1 unit per injection event, it may take at least 60 port injection events to reach this threshold amount.

If the accumulated port injected fuel amount has not reached the threshold amount, at 324, the method continues port injecting a lower than threshold fuel mass with the lift pump deactivated and with the fuel rail pressure at fuel vapor pressure. In addition, with each injection event, the controller may continue to update the accumulated (or integrated) fuel injection amount.

Once the accumulated port injected fuel amount reaches the threshold amount, the method proceeds to 322, wherein the lift pump is reactivated. Reactivating the lift pump causes the port injection fuel rail to be re-pressurized. Thereafter, fuel may be delivered to the engine via port injection at fuel rail pressure that is above fuel vapor pressure. For example, as operator torque demand changes and causes a corresponding change in the amount of fuel to be delivered via port injection relative to direct injection, fuel may resume being delivered at the elevated fuel rail pressure, at higher than minimum pulse-width duty cycles. In addition, after reactivating the lift pump, a nominal output of the high pressure pump may be resumed and a duty cycle commanded to the direct injector may be adjusted in accordance with the operator torque demand. The routine then exits.

Thus, an injection pressure may be conditionally reduced so that when a fuel canister is ready to be purged (such as when the canister load is above a threshold where it is very full, such as may occur after a refueling event) and when the port fuel injection quantity is small (less than a threshold amount, such as less than the minimum pulse-width of the port fuel injector), the port fuel injection pressure may be lowered to reduce both injector-to-injector variability and an injector's shot-to-shot variability, thereby allowing cost reduction in the fuel vapor handling system. In addition to lowering fuel injection pressure, fuel injection voltage may also be increased. This yields the least injection variability in the condition where reduced variability is the most beneficial. As such, operating at high fuel injection pressures may allow the electrical power saving of pulsing the in-tank lift pump and allowing a large dynamic range of fuel injection amounts. Operating at low injection voltages may be desired during selected conditions because on vehicles configured with PFI, the injection voltage is tied to the battery charging voltage and it is useful to operate at low charging voltages at times.

In this way, a port injector may be allowed to operate at fuel vapor pressure for a duration without ingesting fuel vapor and without incurring related issues, such as torque errors and misfires. By operating a port injection fuel rail at fuel vapor pressure, fuel may be port injected at a fuel mass that is less than the minimum pulse width, improving the accuracy and reliability of low fuel mass port injections. As such, this reduces torque errors during conditions or low torque demand. By not requiring the lift pump to be reactivated as soon as it reaches a minimum pressure (such as the fuel vapor pressure), a duration over which the energy intensive lift pump can be maintained deactivated is extended. This provides fuel economy benefits by reducing power consumption for lift pump operation. In addition, lift pump component life can be extended.

In one example, in response to less than a threshold amount of port injected fuel being commanded into a cylinder, a controller may deactivate a lift pump coupled to a port injection fuel rail; and after a fuel rail pressure of the port injection fuel rail has stabilized to a fuel vapor pressure, the controller may send a control signal to port inject the less than threshold amount of fuel. The threshold amount of port injected fuel may correspond to an amount of fuel that is delivered while operating the port injector at a minimum fuel pulse-width. It may be determined that the fuel rail pressure of the port injection fuel rail has stabilized responsive to the fuel rail pressure remaining at the fuel vapor pressure for a threshold (non-zero) duration after a signal commanding deactivation of the lift pump is sent. Further, the controller may command signals to continue port injecting fuel into the cylinder with the lift pump deactivated until an integrated volume of port injected fuel reaches a threshold, and then reactivate the lift pump. By delaying the reactivation of the lift pump until the threshold amount of fuel has been delivered at the fuel vapor pressure condition, lift pump deactivation can be extended without ingesting fuel vapors. Herein the threshold volume may be determined as a function of a volume of the port injection fuel rail. Further, direct fuel injection may be coordinated with the port fuel injection to meet driver torque demand and maintain stoichiometric combustion. For example, the controller may send a control signal to direct inject fuel into the cylinder with the lift pump deactivated, wherein fuel is drawn into a direct injector from a direct injection fuel rail coupled to the lift pump via an intermediate high pressure fuel pump. Direct injecting fuel with the lift pump deactivated may include raising a fuel rail pressure of the direct injection fuel rail from a nominal pressure responsive to the deactivation of the lift pump and then returning the fuel rail pressure of the direct injection fuel rail to the nominal pressure responsive to reactivation of the lift pump.

Turning now to FIG. 4, an example fuel injection adjustment that enables low fuel masses to be delivered via port injection without ingesting fuel vapors is shown. Map 400 depicts pedal position (PP) at plot 402. The pedal position is indicative of an operator torque demand, with the torque demand increasing as the pedal is depressed further. Map 400 depicts engine torque output at plot 404, a lift pump operation state (on or off) at plot 406, and fuel rail pressure at a port injection fuel rail pressurized by the lift pump at plot 408. Map 400 further depicts an accumulated volume of fuel that is port injected into a cylinder at fuel vapor pressure (FVP) at plot 410. Port fuel injection into an engine cylinder is depicted at plot 412, while direct fuel injection into the cylinder is shown at plot 414. All plots are depicted over time along the x-axis. Time markers t1-t3 depict time points of significance during engine operation.

Between t0 and t1, the engine is operating with a lift pump activated (plot 406) and with each cylinder being fueled via both port and direct injection (plots 412, 414). Fuel rail pressure in a port injection fuel rail (plot 408) (as well as a direct injection fuel rail, not shown) is maintained at a nominal operating pressure that is above fuel vapor pressure due to pressurization of fuel in the fuel rails via operation of the lift pump. As operator torque demand changes (plot 402), a ratio of fuel delivered via direct injection relative to port injection may be varied to provide a corresponding engine output torque (plot 404). For example, when operator torque demand increases (such as when the operator increases pedal depression), a higher proportion of the total fuel mass may be delivered as direct injected fuel. As another example, when operator torque demand decreases (such as when the operator reduces pedal depression), a higher proportion of the total fuel mass may be delivered as port injected fuel. However, the torque demand may remain high enough that the amount of fuel to be port injected is above a minimum fuel mass 413 that corresponds to a minimum pulse-width of the port injector.

At t1, responsive to an operator pedal tip-out event, operator torque demand drops and engine torque output is reduced. In one example, the engine is transitioned to an idling condition responsive to the tip-out. Based on input from a look-up table, the controller may determine that the reduced engine torque output may be provided by discontinuing direct injection and only delivering fuel via port injection. Accordingly, at t1, direct injection is disabled. Further, the fuel mass required to be delivered via port injection to meet the reduced torque demand may be lower than the minimum fuel mass 413. To enable the less than minimum fuel mass to be delivered accurately, the lift pump is disabled at t1, such as by discontinuing power supply to the pump.

As a result of lift pump deactivation, fuel rail pressure in the port injection fuel rail starts to drop towards fuel vapor pressure 409. Dropping of fuel rail pressure to fuel vapor pressure 409 may be expedited by repeatedly port injecting fuel at the minimum pulse-width or by pumping fuel into the direct injection fuel rail, for example. At t2, it may be determined that the fuel rail pressure has dropped to, and stabilized at fuel vapor pressure 409. Therefore at t2, port fuel injection of fuel at less than the minimum fuel mass is initiated.

With every port injection event performed with the lift pump deactivated and with the fuel rail pressure at fuel vapor pressure, an amount of fuel delivered is estimated and an accumulated fuel volume is calculated. Thus, as port injection at less than minimum fuel mass continues, an accumulated fuel volume starts to increase. The inventors have recognized that up to an integrated threshold volume 411 of fuel may be accurately port injected with the lift pump off and with the fuel rail pressure at fuel vapor pressure. In one example, threshold volume 411 corresponds to a fraction of a volume of the fuel rail, such as 10% of the fuel rail (e.g., 6 ml).

At t3, responsive to the accumulated fuel volume at fuel vapor pressure reaching threshold volume 411, the lift pump is reactivated and the fuel rail is re-pressurized. Thereafter, port fuel is injected at or above the minimum fuel mass while torque demand is low. Following a tip-in, as torque demand increases, the amount of fuel delivered via port and direct fuel injection is increased and lift pump operation at nominal output is maintained.

If the lift pump were reactivated as soon as fuel rail pressure dropped to fuel vapor pressure, the lift pump would have been reactivated at t2, as indicated by dashed segment 405, and the fuel rail would have been re-pressurized as soon as the pressure dropped to fuel vapor pressure at t2, as indicated by dashed segment 407. As a result of injecting up to a threshold volume 411 of fuel via port injection with fuel rail pressure at fuel vapor pressure, injection accuracy of low fuel masses are increased while enabling the energy consuming lift pump to be held deactivated for a longer duration. In particular, the lift pump may be held deactivated for a duration d1 (between t2 and t3), during which no energy is drawn to operate the lift pump, providing fuel economy benefits. At the same time, injection accuracy of the low fuel mass is not compromised, even though the fuel rail pressure is lowered.

In this way, a controller may port inject fuel with a lift pump deactivated for a number of fuel injection events, wherein a fuel pulse for each of the number of injection events at less than a minimum port injection pulse-width. Then, responsive to an accumulated fuel volume over the number of fuel injection events exceeding a threshold volume, the controller may transition to port injecting fuel with the lift pump activated. Port injecting with the lift pump deactivated may be performed responsive to a drop in engine load to below a threshold load. After the number of fuel injection events have elapsed, the fuel pulse may be raised to or above the minimum port injection pulse-width. The threshold volume may include a fraction of a total volume of a port injection fuel rail. Port injecting fuel with the lift pump deactivated may include port injecting fuel while fuel rail pressure at a port injection fuel rail is at fuel vapor pressure, while port injecting fuel with the lift pump activated may include port injecting fuel while fuel rail pressure at the port injection fuel rail is above fuel vapor pressure.

In some examples, the controller may set a minimum PFI FRP that is above the current fuel vapor pressure at the PFI rail. In this case, the lift pump may be once again powered when the pressure drops to that minimum PFI FRP. This would typically occur while the engine has not been warmed via running for 5 or 10 minutes. Once the fuel in the fuel rail is warm, then fuel vapor pressure is likely sufficient for light fuel injection needs.

In this way, low fuel masses can be precisely delivered via port injection without incurring issues related to fuel vapor ingestion. The technical effect of leveraging the higher vapor tolerance of a port fuel injection by deactivating a lift pump during low engine loads is that energy consumption by the pump may be reduced. By enabling less than minimum pulse width port fuel injections to be performed while a lift pump is deactivated and while fuel rail pressure is and remains at fuel vapor pressure, air-fuel ratio and torque excursions arising from the need to operate port fuel injectors at the minimum pulse width is reduced. Further, fuel vapor purging is less limited at low load conditions, increasing canister purging efficacy over a given drive cycle. By increasing the accuracy of low fuel mass port injections while extending a duration of deactivation of an energy consuming lift pump, fuel economy and torque delivery is improved, improving overall engine performance.

One example method for an engine comprises: in response to a drop in engine load, deactivating a lift pump; and port injecting fuel while fuel rail pressure remains at or around fuel vapor pressure, with the lift pump deactivated. In the preceding example, port injection may commence prior to fuel rail pressure reaching fuel vapor pressure from above, and continue even after fuel rail pressure reaches and remains at or around fuel vapor pressure. In the preceding example, the method additionally or optionally further comprises determining that fuel rail pressure is at or around fuel vapor pressure in response to fuel rail pressure dropping to a value and remaining at that value for a non-zero duration after the deactivating of the lift pump. In any or all of the preceding examples, the method additionally or optionally further comprises repeatedly port injecting fuel while the lift pump is deactivated to reduce the fuel rail pressure to or around the fuel vapor pressure. In any or all of the preceding examples, the method additionally or optionally further comprises, reducing the fuel rail pressure to or around the fuel vapor pressure by transferring fuel from a first fuel line coupling an output of the lift pump to a low pressure port injection fuel rail to a second fuel line the output of the lift pump to a high pressure direct injection fuel rail. In any or all of the preceding examples, additionally or optionally, port injecting fuel includes port injecting a threshold volume of fuel while fuel rail pressure remains at or around fuel vapor pressure, and then reactivating the lift pump. In any or all of the preceding examples, additionally or optionally, port injecting fuel while fuel rail pressure remains at or around fuel vapor pressure includes port injecting fuel at less than minimum pulse-width, and wherein repeatedly port injecting fuel while the lift pump is deactivated to reduce the fuel rail pressure to or around the fuel vapor pressure includes port injecting fuel at the minimum pulse-width. In any or all of the preceding examples, additionally or optionally, the threshold volume is a function of a fuel rail volume, the method further comprising increasing a port injector voltage while port injecting fuel at or around fuel vapor pressure. In any or all of the preceding examples, additionally or optionally, the threshold volume is determined as a ratio of an integrated volume of fuel delivered a port injector relative to a volume of a fuel rail coupled to the port injector. In any or all of the preceding examples, additionally or optionally, the port injecting includes delivering fuel to a cylinder via a port fuel injector, the cylinder further coupled to a direct injector, the method further comprising: disabling the direct injector responsive to the drop in engine load. In any or all of the preceding examples, additionally or optionally, the direct injector receives fuel from a direct injection fuel rail via the lift pump and a high pressure pump, the method further comprising, optionally raising the fuel rail pressure of the direct injection fuel rail before deactivating the lift pump by increasing an output of the high pressure pump. In any or all of the preceding examples, the method additionally or optionally further comprises, after reactivating the lift pump, resuming a nominal output of the high pressure pump. For example, the controller may raise the fuel line pressure (DI pump inlet pressure) to a threshold level before activating the DI pump.

Another example method for an engine comprises: in response to less than a threshold amount of port injected fuel being commanded into a cylinder, deactivating a lift pump coupled to a port injection fuel rail; and after a fuel rail pressure of the port injection fuel rail has stabilized to a fuel vapor pressure, port injecting the less than threshold amount of fuel. In the preceding examples, the method additionally or optionally further comprises continuing to port inject fuel into the cylinder with the lift pump deactivated until an integrated volume of port injected fuel reaches a threshold, and then reactivating the lift pump. In any or all of the preceding examples, additionally or optionally, the threshold volume is a function of a volume of the port injection fuel rail. In any or all of the preceding examples, additionally or optionally, the threshold amount of port injected fuel corresponds to an amount of fuel delivered while operating a port injector at a minimum fuel pulse-width. In any or all of the preceding examples, the method additionally or optionally further comprises expediting a reduction of the fuel rail pressure to the fuel vapor pressure by pumping fuel from downstream of the lift pump and upstream of the port injection fuel rail into a direct injection fuel rail, via a valve, while maintaining each of the lift pump and a direct injector disabled. In any or all of the preceding examples, additionally or optionally, direct injecting fuel with the lift pump deactivated by raising a fuel rail pressure of the direct injection fuel rail from a nominal pressure responsive to the deactivation of the lift pump and returning the fuel rail pressure of the direct injection fuel rail to the nominal pressure responsive to reactivation of the lift pump. In any or all of the preceding examples, the method additionally or optionally further comprises indicating that the fuel rail pressure of the port injection fuel rail has stabilized responsive to the fuel rail pressure remaining at the fuel vapor pressure for a threshold duration.

Another example method for an engine comprises: port injecting fuel with a lift pump deactivated for a number of fuel injection events, a fuel pulse for each of the number of injection events at less than a minimum port injection pulse-width; and responsive to an accumulated fuel volume over the number of fuel injection events exceeding a threshold volume, port injecting fuel with the lift pump activated. In the preceding example, additionally or optionally, the port injecting with the lift pump deactivated is responsive to a drop in engine load to below a threshold load, and wherein after the number of fuel injection events, the fuel pulse is raised to or above the minimum port injection pulse-width. In any or all of the preceding examples, additionally or optionally, the threshold volume includes a fraction of a total volume of a port injection fuel rail. In any or all of the preceding examples, additionally or optionally, port injecting fuel with the lift pump deactivated includes port injecting fuel while fuel rail pressure at a port injection fuel rail is at fuel vapor pressure, and wherein port injecting fuel with the lift pump activated includes port injecting fuel while fuel rail pressure at the port injection fuel rail is above fuel vapor pressure.

In a further representation, a method for an engine comprises: responsive to canister purging conditions being met while an engine load is less than a threshold, disabling direct fuel injection, disabling a lift pump, reducing an injection pressure of a port fuel injector, and after the injection pressure has been reduced to a fuel vapor pressure, port injecting fuel corresponding to the less than threshold engine load while opening a canister purge valve to purge the canister to the engine. In the preceding example, port injecting fuel corresponding to the less than threshold engine load includes port injecting fuel at less than minimum pulse-width. In any or all of the preceding examples, reducing the injection pressure includes releasing fuel from the port injector via repeated port injection at the minimum pulse-width. In any or all of the preceding examples, reducing the injection pressure includes pumping fuel from a first fuel line coupling an output of the lift pump to a low pressure port injection fuel rail to a second fuel line coupling the output of the lift pump to a high pressure direct injection fuel rail. In any or all of the preceding examples, pumping the fuel from the first fuel line to the second fuel line includes pumping the fuel with the lift pump deactivated by opening a valve coupling the first fuel line to the second fuel line. In any or all of the preceding examples, the method further comprises, while reducing the injection pressure, increasing an injection voltage of the port injector.

In a further representation, a method for an engine includes: in response to a drop in engine load, deactivating each of a lift pump and a direct injector; and port injecting fuel at less than minimum pulse-width while fuel rail pressure remains at or around a fuel vapor pressure, with the lift pump deactivated. In the preceding example, the method additionally or optionally further includes, while port injecting at less than minimum pulse-width, extending a duration of the pulse-width. In the preceding example, the method additionally or optionally further includes, while port injecting at less than minimum pulse-width, increasing a voltage applied to the injector.

In a further representation, a method for an engine includes, responsive to a first canister purging condition, purging a fuel vapor canister to an engine intake with a fuel lift pump deactivated and with fuel port injected at less than minimum pulse-width; and responsive to a second canister purging condition, purging the fuel vapor canister to the engine intake with the fuel lift pump activated and with fuel at least direct injected at or above the minimum pulse-width. In the preceding example, during the first canister purging condition, an engine load is lower than a threshold, and wherein during the second canister purging condition, the engine load is higher than the threshold. In any or all of the preceding examples, additionally or optionally, during the first canister purging condition, a total fuel mass to be injected into the engine is below a threshold amount and wherein during the second canister purging condition, the total fuel mass to be injected into the engine is below the threshold amount. In any or all of the preceding examples, additionally or optionally, during the first canister purging condition, direct injection is disabled, and wherein during the second canister purging condition, port injection is disabled. In any or all of the preceding examples, additionally or optionally, during the first canister purging condition, an injection pressure is lower, and wherein during the second canister purging condition, the injection pressure is higher. In any or all of the preceding examples, additionally or optionally, during the first canister purging condition, a fuel injector voltage is higher, and wherein during the second canister purging condition, the fuel injector voltage is lower. Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

in response to a drop in engine load, deactivating a lift pump; and port injecting fuel while fuel rail pressure remains at or around fuel vapor pressure, with the lift pump deactivated.

2. The method of claim 1, further comprising determining that fuel rail pressure is at or around fuel vapor pressure in response to fuel rail pressure dropping to a value and remaining at that value for a non-zero duration after the deactivating of the lift pump.

3. The method of claim 1, further comprising, repeatedly port injecting fuel while the lift pump is deactivated to reduce the fuel rail pressure to or around the fuel vapor pressure.

4. The method of claim 1, further comprising, reducing the fuel rail pressure to or around the fuel vapor pressure by transferring fuel from a first fuel line coupling an output of the lift pump to a low pressure port injection fuel rail to a second fuel line the output of the lift pump to a high pressure direct injection fuel rail.

5. The method of claim 1, wherein port injecting fuel includes port injecting a threshold volume of fuel while fuel rail pressure remains at or around fuel vapor pressure, and then reactivating the lift pump.

6. The method of claim 3, wherein port injecting fuel while fuel rail pressure remains at or around fuel vapor pressure includes port injecting fuel at less than minimum pulse-width, and wherein repeatedly port injecting fuel while the lift pump is deactivated to reduce the fuel rail pressure to or around the fuel vapor pressure includes port injecting fuel at the minimum pulse-width.

7. The method of claim 5, wherein the threshold volume is a function of a fuel rail volume, the method further comprising increasing a port injector voltage while port injecting fuel at or around fuel vapor pressure.

8. The method of claim 5, wherein the threshold volume is determined as a ratio of an integrated volume of fuel delivered a port injector relative to a volume of a fuel rail coupled to the port injector.

9. The method of claim 5, wherein the port injecting includes delivering fuel to a cylinder via a port fuel injector, the cylinder further coupled to a direct injector, the method further comprising: disabling the direct injector responsive to the drop in engine load.

10. A method for an engine, comprising:

in response to less than a threshold amount of port injected fuel being commanded into a cylinder, deactivating a lift pump coupled to a port injection fuel rail; and after a fuel rail pressure of the port injection fuel rail has stabilized to a fuel vapor pressure, port injecting the less than threshold amount of fuel.

11. The method of claim 10, further comprising, continuing to port inject fuel into the cylinder with the lift pump deactivated until an integrated volume of port injected fuel reaches a threshold, and then reactivating the lift pump.

12. The method of claim 11, wherein the threshold volume is a function of a volume of the port injection fuel rail.

13. The method of claim 10, wherein the threshold amount of port injected fuel corresponds to an amount of fuel delivered while operating a port injector at a minimum fuel pulse-width.

14. The method of claim 10, further comprising, expediting a reduction of the fuel rail pressure to the fuel vapor pressure by pumping fuel from downstream of the lift pump and upstream of the port injection fuel rail into a direct injection fuel rail, via a valve, while maintaining each of the lift pump and a direct injector disabled.

15. The method of claim 10, further comprising, optionally direct injecting fuel with the lift pump deactivated by raising a fuel rail pressure of the direct injection fuel rail from a nominal pressure responsive to the deactivation of the lift pump and returning the fuel rail pressure of the direct injection fuel rail to the nominal pressure responsive to reactivation of the lift pump.

16. The method of claim 10, further comprising, indicating that the fuel rail pressure of the port injection fuel rail has stabilized responsive to the fuel rail pressure remaining at the fuel vapor pressure for a threshold duration.

17. A method for an engine, comprising:

port injecting fuel with a lift pump deactivated for a number of fuel injection events, a fuel pulse for each of the number of injection events at less than a minimum port injection pulse-width; and responsive to an accumulated fuel volume over the number of fuel injection events exceeding a threshold volume, port injecting fuel with the lift pump activated.

18. The method of claim 17, wherein the port injecting with the lift pump deactivated is responsive to a drop in engine load to below a threshold load, and wherein after the number of fuel injection events, the fuel pulse is raised to or above the minimum port injection pulse-width.

19. The method of claim 17, wherein the threshold volume includes a fraction of a total volume of a port injection fuel rail.

20. The method of claim 17, wherein port injecting fuel with the lift pump deactivated includes port injecting fuel while fuel rail pressure at a port injection fuel rail is at fuel vapor pressure, and wherein port injecting fuel with the lift pump activated includes port injecting fuel while fuel rail pressure at the port injection fuel rail is above fuel vapor pressure.

* * * * *